US009287036B2

(12) United States Patent
Weber et al.

(10) Patent No.: US 9,287,036 B2
(45) Date of Patent: Mar. 15, 2016

(54) SUPPLEMENTARY TRANSFORMER WINDING

(71) Applicant: ABB TECHNOLOGY AG, Zürich (CH)

(72) Inventors: Benjamin Weber, Winterberg (DE); Bhavesh Patel, Brilon (DE); Jens Tepper, Brilon (DE); Udo Chudobba, Brilon (DE)

(73) Assignee: ABB TECHNOLOGY AG, Zurich (CH)

( * ) Notice: Subject to any disclaimer, the term of this patent is extended or adjusted under 35 U.S.C. 154(b) by 0 days.

(21) Appl. No.: 14/088,035

(22) Filed: Nov. 22, 2013

(65) Prior Publication Data

US 2014/0077913 A1 Mar. 20, 2014

Related U.S. Application Data

(63) Continuation of application No. PCT/EP2012/001506, filed on Apr. 5, 2012.

(30) Foreign Application Priority Data

May 25, 2011 (EP) ..... 11004288

(51) Int. Cl.

| | |
|---|---|
| ***H01F 21/12*** | (2006.01) |
| ***H01F 27/28*** | (2006.01) |
| ***H01F 21/02*** | (2006.01) |
| ***H01F 27/30*** | (2006.01) |
| ***H01F 29/02*** | (2006.01) |
| ***H01H 9/00*** | (2006.01) |

(52) U.S. Cl.

CPC ..... *H01F 27/303* (2013.01); *H01F 29/02* (2013.01); *H01H 9/0005* (2013.01)

(58) Field of Classification Search

CPC ... H01F 27/303; H01F 27/29; H01F 29/0005; H01F 29/02; H01F 29/025; H01F 29/04; H01H 9/0005

USPC ..... 336/170, 138, 140, 147, 150, 5; 323/342, 343, 255, 258

See application file for complete search history.

(56) References Cited

U.S. PATENT DOCUMENTS

| | | | | |
|---|---|---|---|---|
| 3,176,089 | A | 3/1965 | Bleibtreu et al. | |
| 3,179,875 | A * | 4/1965 | Keats | 323/342 |
| 3,603,971 | A * | 9/1971 | Woschetzky et al. | 341/145 |
| 6,734,772 | B2 * | 5/2004 | Owen | 336/150 |

FOREIGN PATENT DOCUMENTS

| | | |
|---|---|---|
| DE | 26 20 211 A1 | 12/1977 |
| DE | 39 36 937 A1 | 5/1991 |
| EP | 1 727 257 A1 | 11/2006 |

OTHER PUBLICATIONS

International Search Report (PCT/ISA/210) mailed on Jun. 13, 2012, by the European Patent Office as the International Searching Authority for International Application No. PCT/EP2012/001506.

* cited by examiner

*Primary Examiner* — Mangtin Lian

(74) *Attorney, Agent, or Firm* — Buchanan Ingersoll & Rooney PC

(57) ABSTRACT

A transformer winding and a dry-transformer are disclosed, which include a main transformer winding, and a supplementary transformer winding configured to be electrically connected in series with the main transformer winding. The supplementary transformer winding can include a first winding module, a second winding module, and a third winding module, each of the winding modules having at least a first, a second and a third winding segment, and wherein each of the winding segments has a tap. A changer is configured to be connected to the taps of the second winding module, and wherein the second winding module is configured to be electrically connected in series to at least one winding segment of the first winding module and the third winding module.

20 Claims, 2 Drawing Sheets

SUPPLEMENTARY TRANSFORMER WINDING

RELATED APPLICATION

This application claims priority as a continuation application under 35 U.S.C. §120 to PCT/EP2012/001506, which was filed as an International Application on Apr. 5, 2012, designating the U.S., and which claims priority to European Application No. 11004288.4 filed on May 25, 2011. The entire contents of these applications are hereby incorporated by reference in their entireties.

FIELD

The disclosure relates to a supplementary transformer winding, which includes a first winding module, a second winding module and a third winding module, each having at least a first, a second and a third winding segment having respective taps, a tap changer, for example, an on-load tap changer, which is connected to the taps of the second winding module, wherein the connections of the second winding module are formed by an outer tap and an output of the tap changer.

BACKGROUND INFORMATION

It is known that power transformers, for example, oil-filled transformers, can be provided with so-called on-load tap changers for increasing their flexibility in the electrical energy supply grid, as a result of which the transformation ratio of the transformer can be matched within certain limits, for example, in a range of from 85% to 115% of the rated voltage. These on-load tap changes can be selector switches which are switched on load and which, depending on given boundary conditions, tap one of, for example, 24 taps of a supplementary winding, which can be connected electrically in series with a respective main transformer winding. In addition, a single winding can be provided, which has corresponding taps in its rear region, for example in the last 20% of its winding. The output of the on-load tap changer can act as the output of the series-connected main and supplementary windings. Such on-load tap changers can be involved and complex for example, to be capable of switching under load current and the specifications in terms of their insulation. In the case of use in oil-filled transformers, a certain degree of simplification is provided at least with respect to the insulation complexity, since the on-load tap changer can be arranged within the oil tank and the on-load tap changer can also be flooded with oil.

The controllability can also be used in so-called dry-type transformers. Dry-type transformers have a rated power in the range of from a few 100 kVA up to several 10 MVA given rated voltages of between 6 kV and 110 kV, for example. The rated power of the dry-type transformers can be below the rated power of oil-filled transformers. For example, dry-type transformers can use less maintenance in comparison with oil-filled transformers since no oil or oil tank is provided. However, dry-type transformers can have increased complexity with respect to the insulation of dry-type transformers. For example, this can also apply correspondingly to on-load tap changes with which dry-type transformers can be equipped.

On-load tap changer arrangements known from the oil-filled transformer sector may not be transferable, or only with a disproportionately degree of complexity, to dry-type transformers.

SUMMARY

A transformer winding is disclosed, comprising: a main transformer winding; and a supplementary transformer winding configured to be electrically connected in series with the main transformer winding, the supplementary transformer winding comprising: a first winding module, a second winding module, and a third winding module, each of the winding modules having at least a first, a second and a third winding segment, and wherein each of the winding segments has a tap; and a tap changer configured to be connected to the taps of the second winding module, and wherein the second winding module is configured to be electrically connected in series to at least one winding segment of the first winding module and the third winding module.

A dry-type transformer is disclosed, comprising: a transformer core; and a transformer winding, the transformer winding comprising: a main transformer winding; and a supplementary transformer winding configured to be electrically connected in series with the main transformer winding, the supplementary transformer winding comprising: a first winding module, a second winding module, and a third winding module, each of the winding modules having at least a first, a second and a third winding segment, and wherein each of the winding segments has a tap; and a tap changer configured to be connected to the taps of the second winding module, and wherein the second winding module is configured to be electrically connected in series to at least one winding segment of the first winding module and the third winding module.

BRIEF DESCRIPTION OF THE DRAWINGS

In the following, exemplary embodiments, will be described in greater detail by reference to the attached drawings, in which.

DETAILED DESCRIPTION

Figure 1:
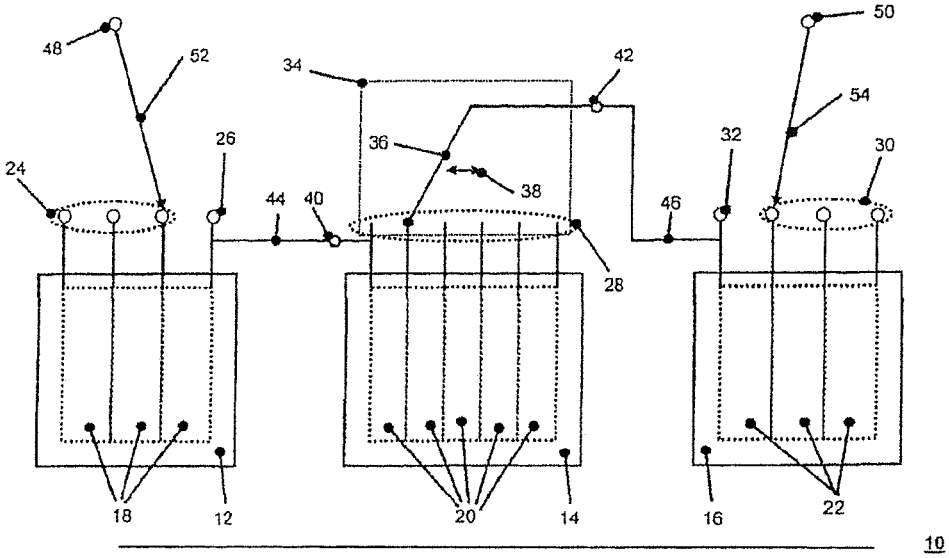
FIG. 1 shows an exemplary first supplementary transformer winding.

In accordance with an exemplary embodiment, a controller for transformer windings, for example, of dry-type transformers, is disclosed, which can include a supplementary transformer winding of the type mentioned at the outset.

In accordance with an exemplary embodiment, the controller can include a second winding module, which can be connected at its two connections to at least one winding segment of a first winding module or a third winding module and which can be electrically connected in series therewith.

By virtue of the supplementary winding being split into three to form a first, a second and a third winding module, wherein an on-load tap changer can be provided for the central, namely the second winding module, the voltage step, which can be managed by the on-load tap changer can be reduced. For example, given a typical number of 24 taps, in each case 8 on each of the three winding modules could be dispensed with. Both the design and the insulation for the on-load tap changer, which is not filled with oil and is therefore, for example, complex, can be reduced.

In the field of use of dry-type transformers, generally only a small voltage step that is used during grid operation for control purposes, which voltage step can be covered by an on-load tap changer. For example, this can be due to the operationally determined relatively low percentage voltage fluctuations at the relatively low voltage levels of dry-type transformers which can be compensated for by a control device such as an on-load tap changer. A relatively large control range known for oil-filled transformers, which control range covers, for example, a range of from 80% to 120% of the rated voltage of the dry-type transformer, can be used when long-term voltage changes related to the grid infrastructure are to be compensated for, for example when it is planned to raise the voltage in a specific part of the grid generally by a few percent. In this case, the on-load tap changer can operate operationally in the upper range of the selectable increments after the increase in voltage, whereas the lower range would then remain unused.

The disclosure provides an on-load tap changer which covers the operationally occurring voltage fluctuation band in terms of control technology and of determining long-term voltage fluctuations by means of the number of series-connected winding segments of the first and third winding modules. For example, for the case where a low number of first and third winding segments, which can be connected in series, the controllable output voltage would correspondingly be in a lower voltage range, while with a correspondingly high number of first and third winding segments connected in series, it would accordingly be in the upper range. In accordance with an exemplary embodiment, long-term fluctuations of the voltage band can be compensated for via the first and third winding segments.

The disclosure can implement such matching of the supplementary winding to long-term voltage changes in the deenergized state and can also manually be implemented because then the interconnection of the winding segments of the first and third winding module, which can be performed correspondingly with relatively low complexity, for example, with screwing or other fastening of a connecting cable or the like between the corresponding taps. The taps are then provided with corresponding fastening means for this case.

In an exemplary embodiment, the design can be symmetrical, which can include three winding modules, of which the central winding module can be provided with an on-load tap changer, having the effect that the shortening of the excursion of the on-load tap changer does not have a negative effect on the short-circuiting response of the transformer or the supplementary transformer winding, which in this case would then likewise be unsymmetrical. In contrast to the variant with only two series-connected winding modules, for example, a first winding module without an on-load tap changer and a second winding module with an on-load tap changer, an improved operational response can therefore be provided. In addition, in the arrangement with three winding modules, a more uniform change in the short-circuit impedance of the transformer in the different tap positions can result.

In an exemplary embodiment, the second winding module of the supplementary transformer winding can have a plurality of winding segments connected electrically in series. For example, the number of winding segments and the respective number of turns can determine the control band of the voltage which can be realized by means of the on-load tap changer. For example, depending on specification in the electrical grid, for example, a maximum of eight, but also in individual cases even two or three, winding segments for a second winding module can be sufficient for implementing the desired control characteristic. The voltage step which can be achieved with a respective winding segment can be, for example, in the range of from 1% to 2% of the rated voltage, with the result that, for example, a step of in total +/−5% results for all winding segments, which can be dependent on the respective boundary conditions. The term rated voltage in this context can relate to the rated voltage of a main transformer winding connected in series with the supplementary winding and can be, for example, 10 kV or 110 kV.

In an exemplary embodiment, the supplementary transformer winding according to the disclosure, the first winding module and the third winding module can have a plurality of first and third winding segments connected electrically in series. The number of winding segments of the first and third winding module determines, together with the respective number of turns, the maximum voltage step with which the controllable voltage band of the second winding module with the on-load tap changer can be shifted for long-term voltage changes. Since this is an offset adjustment, it can be sensible to limit the number to fewer winding segments with a correspondingly higher number of turns, with the result that, for example, in each case four winding segments can be provided per winding module, which winding segments can have, for example, a step of in each case 2.5% of the rated voltage.

In an exemplary embodiment of the disclosure, the contact-making of the respective taps which can be used for producing a series circuit includes the first and/or third winding module can be implemented by means of a mechanically detachable conductor and/or cable connection. A change to the interconnection of the first and third winding modules can be used in the case of long-term changes in the grid conditions, for example, in the case of a slight rise in the rated voltage. For example, this can be realized during a regular maintenance cycle, for example by virtue of corresponding cables or other electrical connections being connected to the respectively desired taps manually. For this purpose, clamping or screw-type connections can be used, for example.

In an exemplary embodiment of the supplementary transformer winding according to the disclosure, at least some of the taps of the first winding module and/or the third winding module can be connected to the inputs of a respective selector switch, with the result that the number of first and third winding segments connected electrically in series with the second winding module can thus be fixed. This variant can be used when short-term or medium-term changes in the grid voltage can also occur, with the result that the offset of the second winding module needs to be adapted correspondingly often. For example, such a selector switch can be switched so as to be deenergized and can be switched manually or else by a drive. For example, by virtue of switching only in the deenergized state, the selector switch can have a correspondingly simple and also compact configuration. In this case, the taps of the first and third winding modules can be equipped with corresponding wiper contacts, for example, via which a moveable consumer can be guided.

In an exemplary embodiment, the number of winding segments connected in series of the first winding module and the number of winding segments connected in series of the third winding module can be approximately the same, for example, identical. By virtue of the fact that a similar number of winding segments can be connected on both sides of the second winding module, the symmetry of the entire supplementary winding can be correspondingly favored and the operational response improved. For example, it may not be the number of winding segments actively connected in series but the number of turns of the winding which are actively connected in series which can be important since the disclosure provides that winding segments with different number of turns can also be provided within one and the same winding module. As a result, for example, the flexibility of the voltage control can be further increased.

In an exemplary embodiment, the contact-making of the first winding module and/or the third winding module with respect to the respective connection to the connections of the second winding module can be performed at the respectively outer tap adjacent to the second winding module. The taps can be arranged at the winding surface, for example, along one path, wherein the first and last taps each form an outer tap. The arrangement of the taps on the winding surface can correlate to a certain extent with the arrangement of the winding segments in the winding. If the tap respectively geometrically adjacent to the second winding module can be used for the electrical series circuit, unnecessary open winding segments with an increased potential between active winding segments can be avoided. This can increase the operational reliability.

In accordance with an exemplary embodiment, the first and second winding modules can be formed by a common winding module with a corresponding number of taps. For example, contact-making between both winding modules may not be needed since the winding modules may not be galvanically isolated. In accordance with an exemplary embodiment, this can simplify the manufacture of such a supplementary winding. For example, in the case of a common winding module, the first and second winding segments can include a different number of turns. The arrangement of open winding segments between active winding segments can also be avoided.

A transformer winding is disclosed, which can include a supplementary transformer winding 10 and a main transformer winding 11 connected electrically in series therewith (FIG. 1). The main transformer winding 11 can be used for introducing the main component of the voltage induced in the entire winding, for example 85%, while the supplementary winding contributes at most 30%, for example, to the induced voltage, of which, for example, in each case 10% relates to the first, second and third winding modules. For example, the split can be 12%, 6% and 12%.

In accordance with an exemplary embodiment, a corresponding three-phase transformer winding and to a dry-type transformer having a transformer winding is disclosed.

FIG. 1 shows an exemplary first supplementary transformer winding 10 including a first winding module 12, a second winding module 14 and a third winding module 16. The winding modules 12, 14, 16 can be galvanically isolated, and arranged on one and the same winding body around a common axis of rotation. The first winding module 12 can have three first winding segments 18, which are connected galvanically in series and, for contact-making with their respective connections as taps 24, 26, are guided onto the surface of the winding body (not explicitly shown). A third winding module 16 which has three third winding segments 22 can be connected in series, whose connections are guided as taps 30, 32 onto the surface of the winding body (not shown), has a similar design to the first winding module 12.

A second winding module 14 can include five exemplary second winding segments 20, which can be connected electrically in series, whose connections are guided as taps 28 onto the surface of the winding body (not shown). The taps 28 of the second winding module 14 can be electrically connected to the inputs of a tap changer 34, for example, an on-load tap changer, which optionally connects one of the taps 28 electrically to its output. In accordance with an exemplary embodiment, this can take place by means of a contact 36 which can be moveable in the arrow direction 38 and which can produce a respective electrical connection with wiper contacts connected at the taps. The connections 40, 42 of the second winding module 14 can be formed by an outer tap and the output of an on-load tap changer 34. The connections 40, 42 can be galvanically connected to the respectively outer taps and the taps which are adjacent to the second winding module 14 (taps 26, 32) of the first winding module 12 and the third winding module 16 by means of the contacts 44, 46. The contacts 44, 46 can be, for example, insulated cables or else copper bars or other conductors. Thus, the winding modules 12, 14, 16 can be connected electrically in series.

The taps 24, 28 of the first winding module 12 can be provided with corresponding contact-making devices, with the result that optionally an electrical connection to a first connection 48 of the supplementary transformer winding can be produced by means of a contact 52. This can be performed both by means of a cable or conductor connection to be arranged and fastened manually or else by means of a selector switch, which, from an electrical point of view, performs the same function. This selector switch can be, for example, configured such that it only switches in the deenergized state in order to thus reduce its design complexity. Similarly, the taps 30, 32 of the third winding module 22 can be connected by means of a contact to a second connection 50 of the supplementary transformer winding. In accordance with an exemplary embodiment, a connection of the supplementary transformer winding can be provided via its two connections 48, 50.

Figure 2:
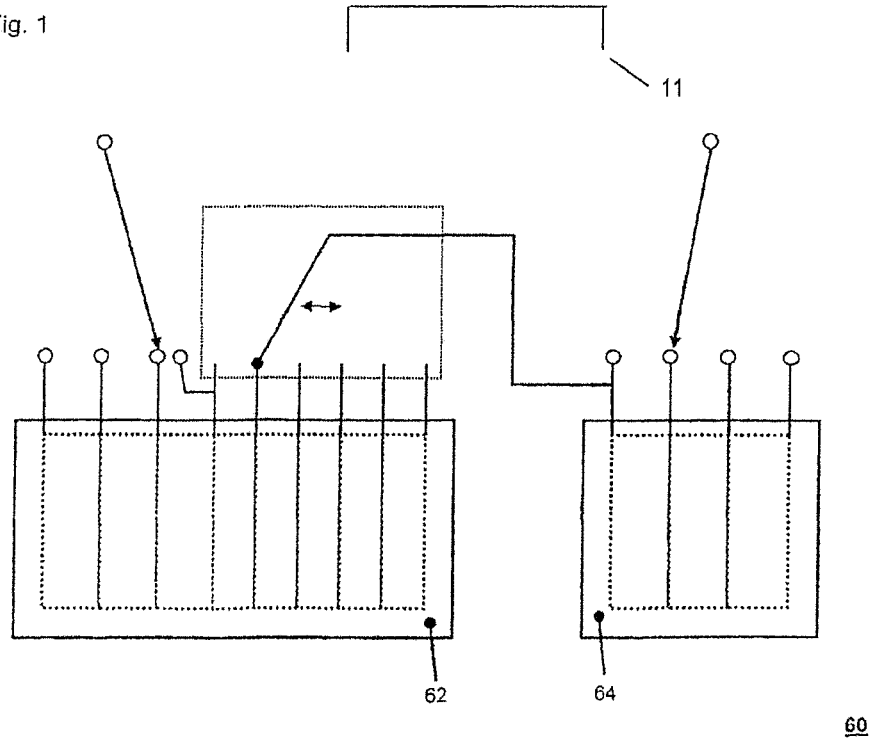
FIG. 2 shows an exemplary second supplementary transformer winding.

FIG. 2 shows an exemplary supplementary transformer winding 60, which corresponds in terms of its essential components to the first transformer winding 10 shown in FIG. 1. However, in this exemplary embodiment, the first and the second winding module can be combined in a common winding module 62, which, for example, can be galvanically isolated from a third winding module 64. This isolation can introduce the output of the on-load tap changer into the third winding module and can avoid a short circuit with the non-active second winding segments in the rear region (shown on the right-hand side in the figure) of the common winding module 62.

Figure 3:
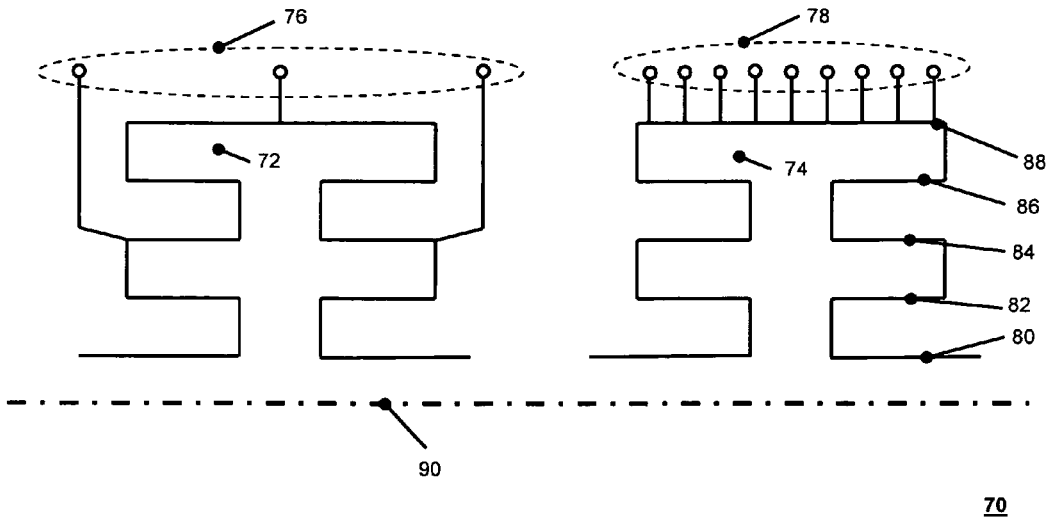
FIG. 3 shows an exemplary first and second winding module in a sectional view.

FIG. 3 shows an exemplary first and second winding module in a sectional view 70. This sectional view shows a supplementary transformer winding according to the disclosure, wherein the supplementary transformer winding can be designed with layered windings around a winding axis 90. An exemplary first winding module is denoted by the reference numeral 72, and a second exemplary winding module is denoted by the reference numeral 74. The continuous lines with which the winding modules 72, 74 are illustrated do not describe an electrical conductor, however, but instead the winding scheme of a conductor wound around the winding axis 90, for example, the cross-sectional profile of conductor sections arranged next to one another. The conductor can be wound in a plurality of winding layers 80, 82, 84, 86, 88, for example, in a meandering fashion from the radially inner region to the radially outer region. For example, the first winding module 72, which would substantially also correspond to a third winding module, can have three exemplary taps 76. The second winding module 74 can have nine exemplary taps 78, which can be connected to an on-load tap changer (not shown). The number of windings of the winding segments interconnected between adjacent taps can be higher in the first winding module 72 than in the second winding module 74, since this is only used for determining the offset of the voltage control band of the second winding module, which can be less finely graduated.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Exemplary first supplementary transformer winding
12 First winding module
14 Second winding module
16 Third winding module
18 Winding segments of first winding module
20 Winding segments of second winding module
22 Winding segments of third winding module
24 Taps of first winding module
26 Outer tap adjacent to second winding module
28 Taps of second winding module
30 Taps of third winding module
32 Outer tap adjacent to second winding module
34 On-load tap changer
36 Moveable contact
38 Movement direction of contact
40 First connection of second winding module
42 Second connection of second winding module
44 Contact between first and second winding modules
46 Contact between second and third winding modules
48 First connection of supplementary transformer winding
50 Second connection of supplementary transformer winding
52 Contact of first connection of supplementary transformer winding
54 Contact of second connection of supplementary transformer winding
60 Exemplary second supplementary transformer winding
62 Common winding module
64 Third winding module
70 Exemplary first and second winding modules in a sectional view
72 Exemplary first winding module
74 Exemplary second winding module
76 Taps of first winding module
78 Taps of second winding module
80 First winding layer of second winding module
82 Second winding layer of second winding module
84 Third winding layer of second winding module
86 Fourth winding layer of second winding module
88 Fifth winding layer of second winding module
90 Winding axis

What is claimed is:

1. A transformer winding, comprising:

a main transformer winding; and a supplementary transformer winding configured to be electrically connected in series with the main transformer winding, the supplementary transformer winding comprising:

a first winding module, a second winding module, and a third winding module, each of the winding modules having at least a first, a second and a third winding segment, and wherein each of the winding segments has a plurality of taps;

an on-load tap changer configured to be connected to the taps of the second winding module, and wherein the second winding module is configured to be electrically connected in series to at least one winding segment of the first winding module and the third winding module; and at least one selector switch, wherein the at least one selector switch is connected to at least one of the plurality of taps of the first winding module and at least one of the plurality of taps the third winding module.

2. The transformer winding as claimed in claim 1, comprising:

an outer tap and an output of the on-load tap changer, which are configured to connect the second winding module to the least one winding segment of the first winding module and the third winding module.

3. The transformer winding as claimed in claim 1, comprising:

a plurality of winding segments which are connected electrically in series with the second winding module.

4. The transformer winding as claimed in claim 1, comprising;

a plurality of winding segments connected electrically in series with the first winding module and the third winding module.

5. The transformer winding as claimed in claim 1, comprising:

a mechanically detachable conductor and/or cable connection, which is configured to contact the respective taps to produce a series circuit with the first and/or third winding modules.

6. The transformer winding as claimed in claim 1, wherein the first winding module and/or the third winding module is configured to be electrically connected in series with the second winding module.

7. The transformer winding as claimed in claim 1, wherein a number of winding segments connected in series of the first winding module and a number of winding segments connected in series of the third winding module are equal.

8. The transformer winding as claimed in claim 1, wherein a contact of the first winding module and/or the third winding module with respect to a respective connection to a connection of the second winding module is performed at a respective outer tap adjacent to the second winding module.

9. The transformer winding as claimed in claim 1, wherein a number of the first and third winding segments connected electrically in series with the second winding module is fixed.

10. A supplementary transformer winding configured to be electrically connected in series with a main transformer winding, the supplementary transformer winding comprising:

a first winding module, a second winding module, and a third winding module, each of the winding modules having at least a first, a second and a third winding segment, and wherein each of the winding segments has a plurality of taps;

an on load tap changer configured to be connected to the taps of the second winding module, and wherein the second winding module is configured to be electrically connected in series to at least one winding segment of the first winding module and the third winding module; and at least one selector switch, wherein the at least one selector switch is connected to at least one of the plurality of taps of the first winding module and at least one of the plurality of taps the third winding module.

11. The transformer as claimed in claim 10, comprising:

an outer tap and an output of the on load tap changer, which are configured to connect the second winding module to the least one winding segment of the first winding module and the third winding module.

12. The transformer as claimed in claim 10, comprising:

a plurality of winding segments which are connected electrically in series with the second winding module.

13. The transformer as claimed in claim 10, comprising;

a plurality of winding segments connected electrically in series with the first winding module and the third winding module.

14. The transformer as claimed in claim 10, comprising:

a mechanically detachable conductor and/or cable connection, which is configured to contact the respective taps to produce a series circuit with the first and/or third winding modules.

15. The transformer as claimed in claim 10, wherein the first winding module and/or the third winding module is configured to be electrically connected in series with the second winding module.

16. The transformer as claimed in claim 10, wherein a number of winding segments connected in series of the first winding module and a number of winding segments connected in series of the third winding module are equal.

17. The transformer as claimed in claim 10, wherein a contact of the first winding module and/or the third winding module with respect to a respective connection to a connection of the second winding module is performed at a respective outer tap adjacent to the second winding module.

18. The transformer as claimed in claim 10, wherein the on load tap changer is configured to be switched independently from the first and third winding modules.

19. The transformer as claimed in claim 10, wherein at least one of the taps of the first winding module and/or the third winding module are connected electrically in series with the second winding module, and wherein a number of winding segments of the at least one of the taps of the first winding module and/or the third winding module connected in series to the second winding module is fixed.

20. The transformer as claimed in claim 10, wherein a number of the first and third winding segments connected electrically in series with the second winding module is fixed.

* * * * *